US011138922B2

(12) United States Patent
Lee et al.

(10) Patent No.: US 11,138,922 B2
(45) Date of Patent: Oct. 5, 2021

(54) LED DRIVING APPARATUS HAVING MITIGATED COMMON IMPEDANCE EFFECT

(71) Applicant: SAPIEN SEMICONDUCTORS INC., Ulsan (KR)

(72) Inventors: Jae Hoon Lee, Busan (KR); Jin Woong Jang, Suwon-Si (KR)

(73) Assignee: SAPIEN SEMICONDUCTORS INC., Ulsan (KR)

( * ) Notice: Subject to any disclaimer, the term of this patent is extended or adjusted under 35 U.S.C. 154(b) by 5 days.

(21) Appl. No.: 16/680,745

(22) Filed: Nov. 12, 2019

(65) Prior Publication Data

US 2020/0160778 A1 May 21, 2020

(30) Foreign Application Priority Data

Nov. 15, 2018 (KR) ..... 10-2018-0140930

(51) Int. Cl.

*G09G 3/32* (2016.01)
*H05B 45/325* (2020.01)
*H05B 45/00* (2020.01)

(52) U.S. Cl.

CPC ..... *G09G 3/32* (2013.01); *H05B 45/325* (2020.01); *G09G 2300/089* (2013.01);
(Continued)

(58) Field of Classification Search

CPC ..... G09G 3/32; G09G 2300/089; G09G 2310/0272; G09G 2310/0291; G09G 2330/028; H05B 45/325; H05B 45/60
See application file for complete search history.

(56) References Cited

U.S. PATENT DOCUMENTS 6,351,327 B1 * 2/2002 Walsh ..... G09G 3/3655 345/87
2003/0011408 A1 * 1/2003 Tsuchi ..... H03K 17/164 327/108

(Continued)

FOREIGN PATENT DOCUMENTS

JP 2009038747 A 2/2009
JP 1464062 B2 5/2010

(Continued)

OTHER PUBLICATIONS

Office Action issued in corresponding Korean Application No. 10-2018-0140930, dated Nov. 13, 2019 (7 pages).

*Primary Examiner* — Ariel A Balaoing
(74) *Attorney, Agent, or Firm* — Osha Bergman Watanabe & Burton LLP

(57) ABSTRACT

The present specification discloses a light-emitting diode (LED) driving apparatus in which a voltage drop phenomenon due to a common impedance is mitigated. In the LED driving apparatus according to the present specification, a circuit is configured by combining N-type metal-oxide-semiconductor (NMOS) transistors or P-type MOS (PMOS) transistors such that a positive power source or a negative power source is not connected to a source terminal of a metal oxide semiconductor field-effect transistor (MOSFET). To this end, it is possible to eliminate common impedance effects on the positive power source or the negative power source.

10 Claims, 11 Drawing Sheets
(4 of 11 Drawing Sheet(s) Filed in Color)

(52) U.S. Cl.
CPC ..... *G09G 2310/0272* (2013.01); *G09G 2310/0291* (2013.01); *G09G 2330/028* (2013.01); *H05B 45/60* (2020.01)

(56) References Cited

U.S. PATENT DOCUMENTS

| | | | | |
|---|---|---|---|---|
| 2004/0189275 | A1* | 9/2004 | Yoneyama | G05F 3/262 323/315 |
| 2006/0197577 | A1* | 9/2006 | Mukherjee | H03F 1/32 327/317 |
| 2009/0066260 | A1* | 3/2009 | Sugimoto | G09G 3/22 315/169.3 |
| 2010/0156867 | A1* | 6/2010 | Kim | G09G 3/3648 345/208 |
| 2016/0072446 | A1* | 3/2016 | Jeong | H03F 3/45219 330/260 |
| 2016/0379564 | A1* | 12/2016 | Inoue | G05F 3/262 345/212 |

FOREIGN PATENT DOCUMENTS

| | | | |
|---|---|---|---|
| JP | 2013110206 | A | 6/2013 |
| KR | 20120115886 | A | 10/2012 |

* cited by examiner

LED DRIVING APPARATUS HAVING MITIGATED COMMON IMPEDANCE EFFECT

CROSS-REFERENCE TO RELATED APPLICATION

This application claims priority to and the benefit of Korean Patent Application No. 2018-0140930, filed on Nov. 15, 2018, the disclosure of which is incorporated herein by reference in its entirety.

BACKGROUND

1. Field of the Invention

The present disclosure relates to a light-emitting diode (LED) driving apparatus, and more particularly, to an LED driving apparatus having a mitigated common impedance effect.

2. Description of Related Art

Self-emissive light-emitting diodes (LEDs) or organic LEDs (OLEDs) are currently being applied to various products, and in particular, in the case of LEDs having excellent durability and light emission efficiency, techniques related to miniaturization are rapidly evolving, and the LEDs are expected to replace conventional displays in many applications in the future.

However, unlike conventional liquid crystal displays (LCDs), in LED displays in which a pixel is implemented with an LED, each light-emitting element may be driven by a current, and thus a problem may occur in that a display quality is degraded, such as by deterioration of the light-emitting element, due to an influence of a voltage drop (IR drop) in an image that consumes high current.

FIG. 1 is a circuit diagram of a voltage-driven LED pixel according to the related art.

Referring to FIG. 1, Vcc_P is a pixel power source, Vcc_D is a driving circuit power source, GND_P is a pixel ground, and GND_D is a driving circuit ground. Although only one micro LED is illustrated in FIG. 1, a plurality of LEDs may be connected to one driving circuit. Here, the plurality of LEDs may be electrically connected in parallel through Vcc_P and GND_P. Accordingly, the related art of the voltage-driven method illustrated in FIG. 1 generates side effects in which several amperes of current flow due to a plurality of pixels and a common impedance at GND_P acts as a voltage drop of V=IR, thereby reducing the amount of pixel current. Such a phenomenon causes the amount of driving current to be varied according to an input image, which makes it impossible to realize an accurate image.

FIG. 2 is a graph illustrating a simulation result of the voltage drop (IR drop) generated in the driving circuit according to the related art.

FIG. 3 is a circuit diagram of a pulse width modulation (PWM)-driven LED pixel according to the related art.

Referring to FIG. 3, it may be seen that a PWM control switch PWM_CRTL is disposed instead of a capacitor connected to a switch unlike the voltage-driven method illustrated in FIG. 1. In the PWM-driven method, even though there is a difference in that the current is turned on/off through the PWM control switch PWM_CRTL, the same IP drop problem occurs.

In particular, in the case of a micro LED that has an advantage in high brightness characteristics, the problem is more serious, and a method of reinforcing power wiring is generally performed as a measure for improvement. However, in this case, there are cost disadvantages associated with an additional increase in cost in semiconductor processes.

Further, in the case of a micro display that is to be applied to products such as an augmented reality (AR) device, a pixel size is so small that a space required to reinforce the power wiring is not secured, thereby increasing difficulties in designing micro displays.

DOCUMENT OF PRIOR ART

Patent Documents (Patent Document 0001) Korean Patent Publication No. 10-2012-0115886, Published on Oct. 19, 2012.

SUMMARY

The present specification is directed to providing a light-emitting diode (LED) driving apparatus in which a voltage drop phenomenon due to a common impedance is mitigated.

The present specification is not limited to the objectives described above, and the other objectives which are not described above will be clearly understood by those skilled in the art from the following specification.

According to an aspect of the present specification, there is provided an LED driving apparatus including a plurality of pixel circuits and a driving circuit electrically connected to the plurality of pixel circuits. Each of the pixel circuits includes a pixel line configured to connect between a pixel positive power source and a pixel negative power source, an LED connected in series to the pixel line, a first pixel metal oxide semiconductor field-effect transistor (MOSFET) connected in series to the pixel line and turned on by a voltage output from the driving circuit, a second pixel MOSFET connected in series to the pixel line and connected to a source terminal of the first pixel MOSFET, and a third pixel MOSFET connected in series to the pixel line and turned on by a pulse width modulation (PWM) signal. The driving circuit includes a driving line configured to connect between a driving positive power source and a driving negative power source, a current source connected in series to the driving line to apply a reference current, a first driving MOSFET connected in series to the driving line and connected to a gate terminal of the first pixel MOSFET, and a second driving MOSFET connected in series to the driving line and connected to a gate terminal of the second pixel MOSFET and a source terminal of the first driving MOSFET.

The first pixel MOSFET may be connected to a negative electrode of the LED, and the second pixel MOSFET may be connected between the first pixel MOSFET and the pixel negative power source.

In this case, the first driving MOSFET may be connected to a negative electrode of the current source, and the second driving MOSFET may be connected between the first driving MOSFET and the driving negative power source.

The first pixel MOSFET may be connected to a positive electrode of the LED, and the second pixel MOSFET may be connected between the first pixel MOSFET and the pixel positive power source.

In this case, the first driving MOSFET may be connected to a positive electrode of the current source, and the second driving MOSFET may be connected between the first driving MOSFET and the driving positive power source.

The first pixel MOSFET and the first driving MOSFET may be P-type MOSFETs, the second pixel MOSFET and the second driving MOSFET may be N-type MOSFETs, and a gate terminal and a drain terminal of the first driving MOSFET may be short-circuited.

A gate terminal of the second driving MOSFET and a drain terminal of the second driving MOSFET may be short-circuited.

The gate terminal of the second pixel MOSFET and a gate terminal of the second driving MOSFET may be connected to a bias voltage source.

The LED driving apparatus according to the present specification may further include a buffer gate connected between the gate terminal of the first pixel MOSFET and the gate terminal of the first driving MOSFET.

According to another aspect of the present specification, there is provided a light-emitting diode (LED) driving apparatus including a plurality of pixel circuits and a driving circuit electrically connected to the plurality of pixel circuits. Each of the pixel circuits includes a pixel line configured to connect between a pixel positive power source and a pixel negative power source, an LED connected in series to the pixel line, a first pixel MOSFET connected in series to the pixel line and turned on by a voltage output from the driving circuit, a second pixel MOSFET connected in series to the pixel line and connected to a source terminal of the first pixel MOSFET, and a capacitor connected between a gate terminal of the first pixel MOSFET and a gate terminal of the second pixel MOSFET. The driving circuit includes a driving line configured to connect between a driving positive power source and a driving negative power source, a current source connected in series to the driving line to apply a reference current, a first driving MOSFET connected in series to the driving line and connected to the gate terminal of the first pixel MOSFET, a second driving MOSFET connected in series to the driving line and connected to the gate terminal of the second pixel MOSFET and a source terminal of the first driving MOSFET, and a switch element connected between the gate terminal of the first pixel MOSFET and a gate terminal of the first driving MOSFET.

The first pixel MOSFET may be connected to a negative electrode of the LED, and the second pixel MOSFET may be connected between the first pixel MOSFET and the pixel negative power source.

In this case, the first driving MOSFET may be connected to a negative electrode of the current source, and the second driving MOSFET may be connected between the first driving MOSFET and the driving negative power source.

The first pixel MOSFET may be connected to a positive electrode of the LED, and the second pixel MOSFET may be connected between the first pixel MOSFET and the pixel positive power source.

In this case, the first driving MOSFET may be connected to a positive electrode of the current source, and the second driving MOSFET may be connected between the first driving MOSFET and the driving positive power source.

The first pixel MOSFET and the first driving MOSFET may be P-type MOSFETs, the second pixel MOSFET and the second driving MOSFET may be N-type MOSFETs, and a gate terminal and a drain terminal of the first driving MOSFET may be short-circuited.

A gate terminal of the second driving MOSFET and a drain terminal of the second driving MOSFET may be short-circuited.

The gate terminal of the second pixel MOSFET and a gate terminal of the second driving MOSFET may be connected to a bias voltage source.

The LED driving apparatus according to the present specification may further include a buffer gate connected between the switch element and the gate terminal of the first driving MOSFET.

The LED driving apparatus according to the present specification may be one component of an LED display.

Other details of the present disclosure are included in the following detailed description and the drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other objects, features, and advantages of the present disclosure will become more apparent to those of ordinary skill in the art by describing exemplary embodiments thereof in detail with reference to the accompanying drawings, in which.

DETAILED DESCRIPTION OF THE EMBODIMENTS

Figure 1:
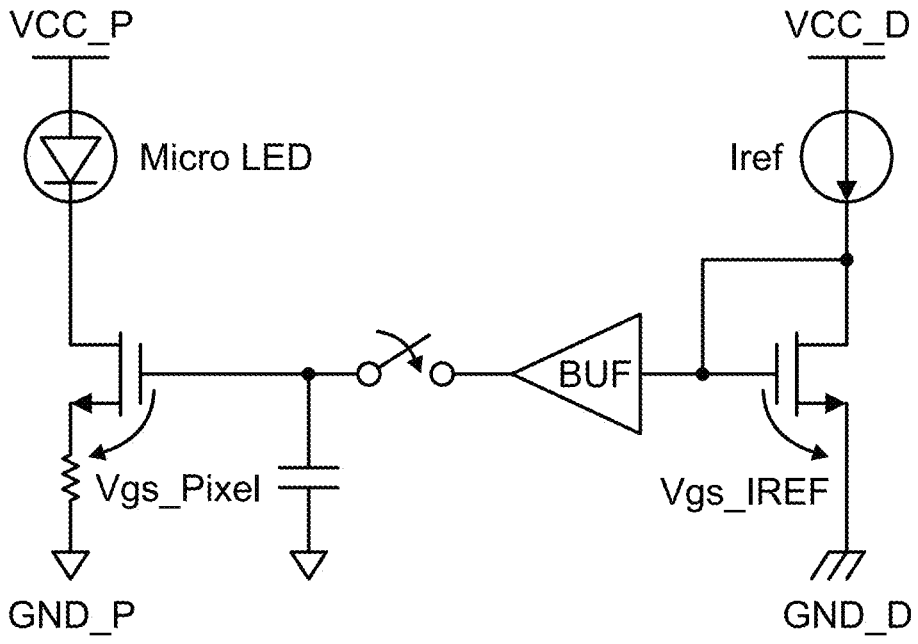
FIG. 1 (Prior Art)
FIG. 1 is a circuit diagram of a voltage-driven light-emitting diode (LED) pixel according to the related art.
Figure 2:
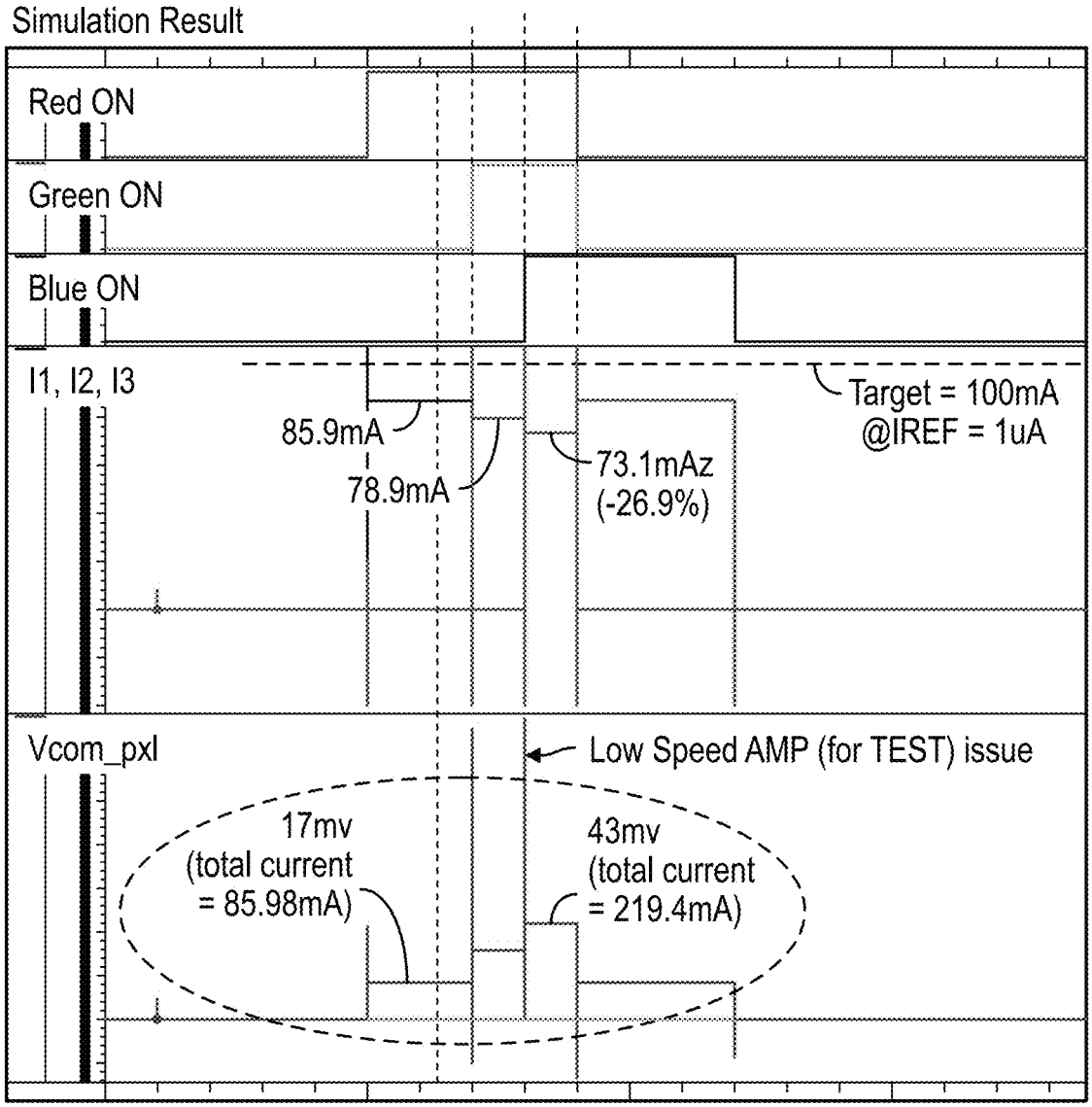
FIG. 2 (Prior Art)
FIG. 2 is a graph illustrating a simulation result of a voltage drop (IR drop) generated in a driving circuit according to the related art.
Figure 3:
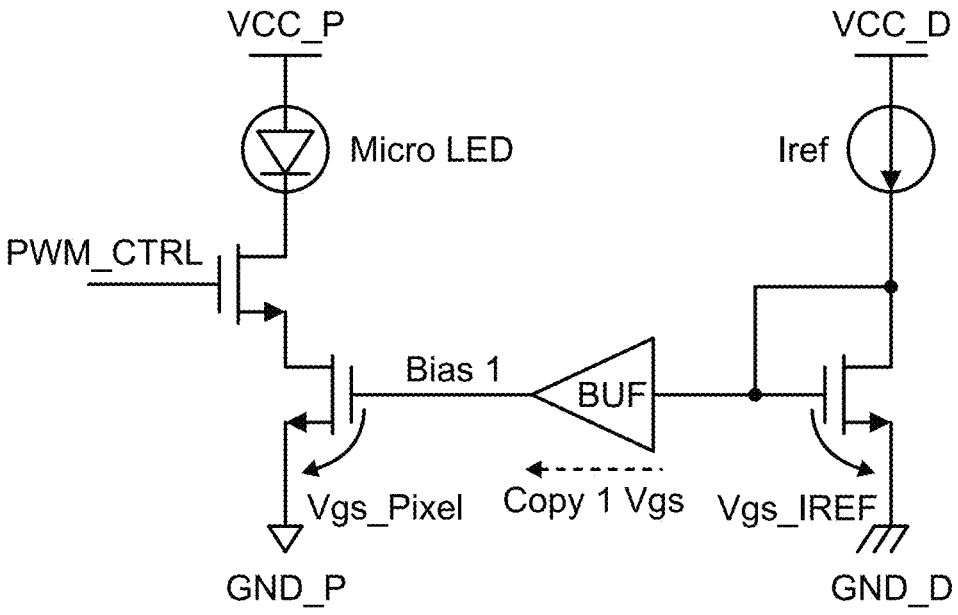
FIG. 3 (Prior Art)
FIG. 3 is a circuit diagram of a pulse width modulation (PWM)-driven LED pixel according to the related art.

Advantages and features, and methods of achieving the same of the present disclosure disclosed in the present specification will be more clearly understood from embodiments described below with reference to the accompanying drawings. However, the present specification is not limited to the embodiments to be disclosed below but may be implemented in various different forms. The present embodiments are provided only to complete the present specification and to fully provide a person having ordinary skill in the art (hereinafter those skilled in the art) to which the present specification pertains with the category of the present specification, and the scope of the present specification will be defined by the appended claims.

The terms used in the present specification are for explaining the embodiments but are not intended to limit the scope of the present specification. As used herein, the singular forms "a," "an," and "the" are intended to include the plural forms as well, unless the context clearly indicates otherwise. It will be understood that the terms "comprise" or "comprising" when used herein, specify some stated components, steps, operations and/or elements, but do not preclude the presence or addition of one or more other components, steps, operations and/or elements. The same reference number refers to the same component in the drawings throughout the specification, and the term "and/or" includes any and all combinations of one or more of the associated listed components. Although the terms "first," "second," and the like may be used to describe various components, these components should not be limited by these terms. These terms are only used to distinguish one component from another component. Therefore, a first component described below may be a second component within the technical scope of the present disclosure.

Unless otherwise defined, all terms (including technical and scientific terms) used in the present specification may be used in a sense commonly understood by those skilled in the art to which the present specification pertains. Also, it will be understood that terms, such as those defined in commonly used dictionaries, will not be interpreted in an idealized or overly formal sense unless expressly so defined herein.

In the following embodiments, the term "on" used in connection with a device state may refer to an activated state of a device, and the term "off" used in connection with the device state may refer to a deactivated state of the device. The term "on" used in connection with a signal received by the device may refer to a signal that activates the device, and the term "off" used in connection with the signal received by the device may refer to a signal that deactivates the device. The device may be activated by a high voltage or a low voltage. For example, a P-type transistor is activated by a low voltage, and an N-type transistor is activated by a high voltage. Thus, it should be understood that an "on" voltage of the P-type transistor has an opposite (low to high) voltage level with respect to an "on" voltage of the N-type transistor.

It will further be understood that the terms "comprise" and/or "comprising" used herein specify the presence of stated features or components, but do not preclude the presence or addition of one or more other features or components. Hereinafter, embodiments of the present disclosure will be described in detail with reference to the accompanying drawings.

Methods of a light-emitting diode (LED) driving apparatus according to the present specification may be divided into a pulse width modulation (PWM)-driven method and a voltage-driven method. FIGS. 4 to 7 illustrate embodiments of the PWM-driven method, and FIGS. 8 to 11 illustrate embodiments of the voltage-driven method. In both methods, a circuit is configured by combining N-type metal-oxide-semiconductor (NMOS) transistors or P-type MOS (PMOS) transistors such that a positive power source or a negative power source is not connected to a source terminal of a metal oxide semiconductor field-effect transistor (MOSFET) in the configuration of the circuit. Through this, a common impedance effect may be eliminated at the positive power source or the negative power source.

Figure 4:
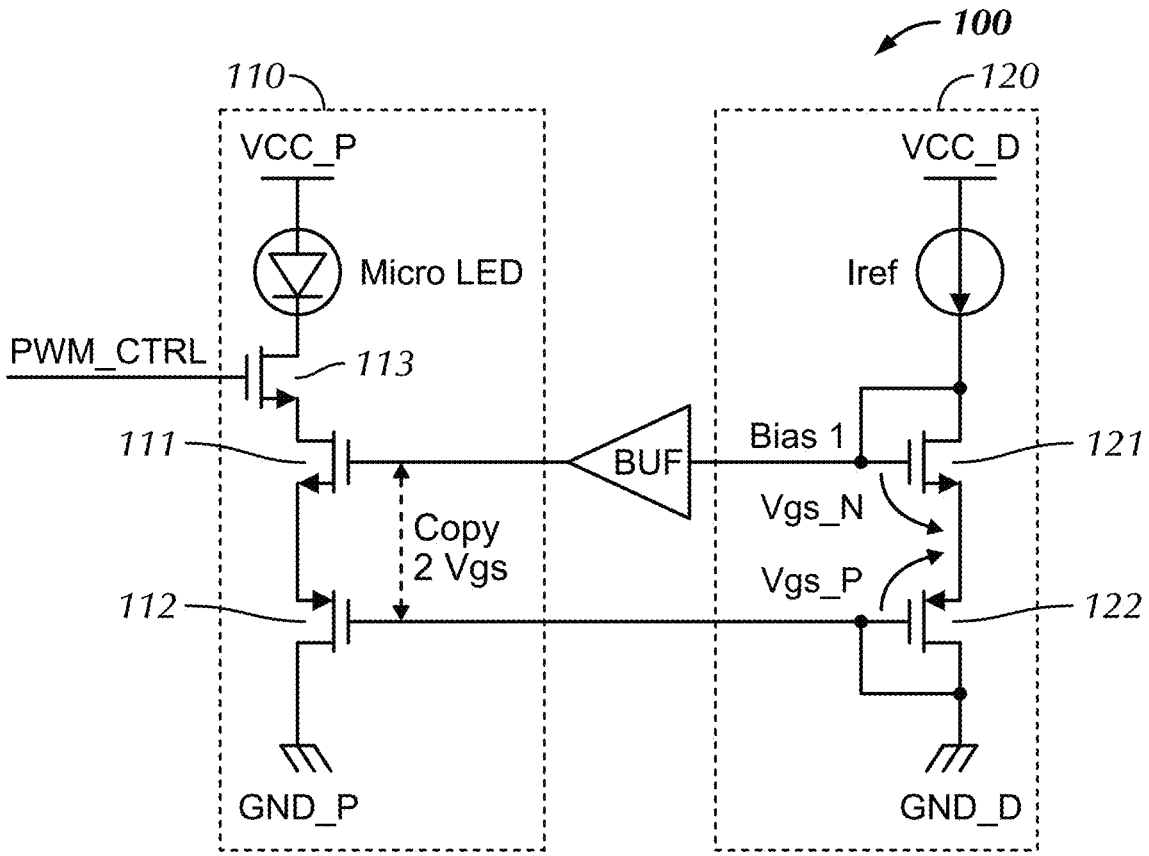
FIG. 4 is a circuit diagram of a first embodiment of a PWM-driven method.

FIG. 4 is a circuit diagram of a first embodiment of the PWM-driven method.

Figure 5:
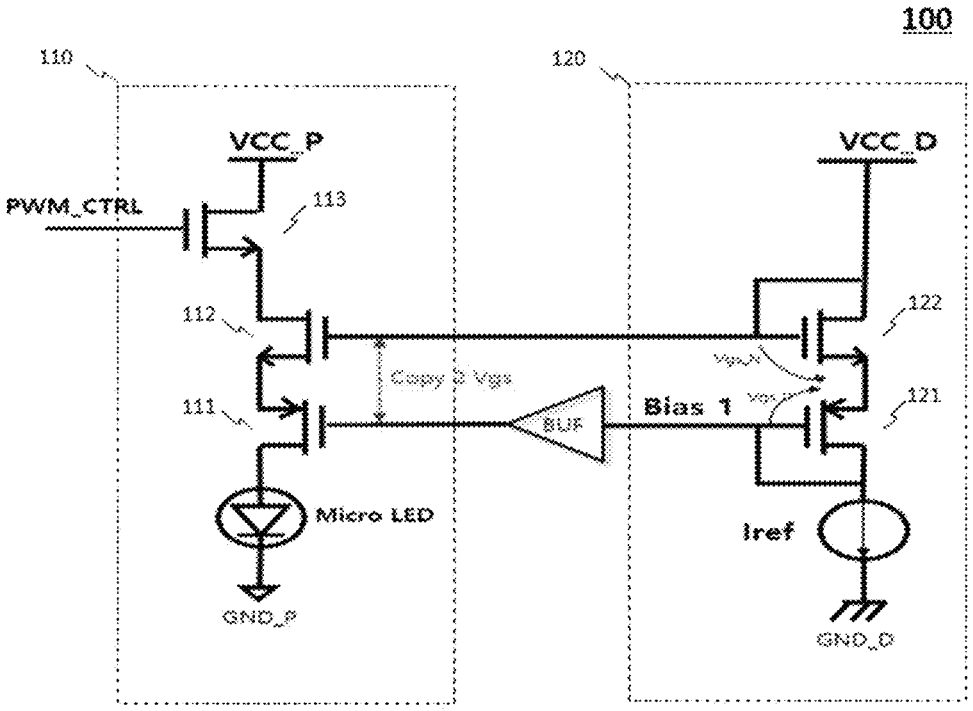
FIG. 5 is a circuit diagram of a second embodiment of the PWM-driven method.

FIG. 5 is a circuit diagram of a second embodiment of the PWM-driven method.

Figure 6:
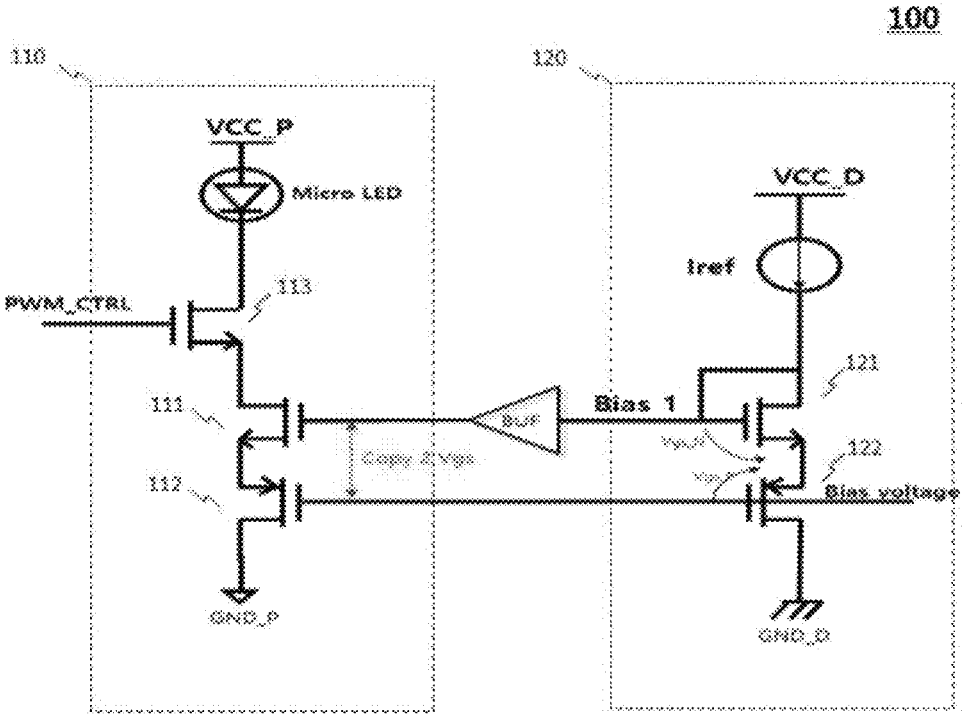
FIG. 6 is a circuit diagram of a third embodiment of the PWM-driven method.

FIG. 6 is a circuit diagram of a third embodiment of the PWM-driven method.

Figure 7:
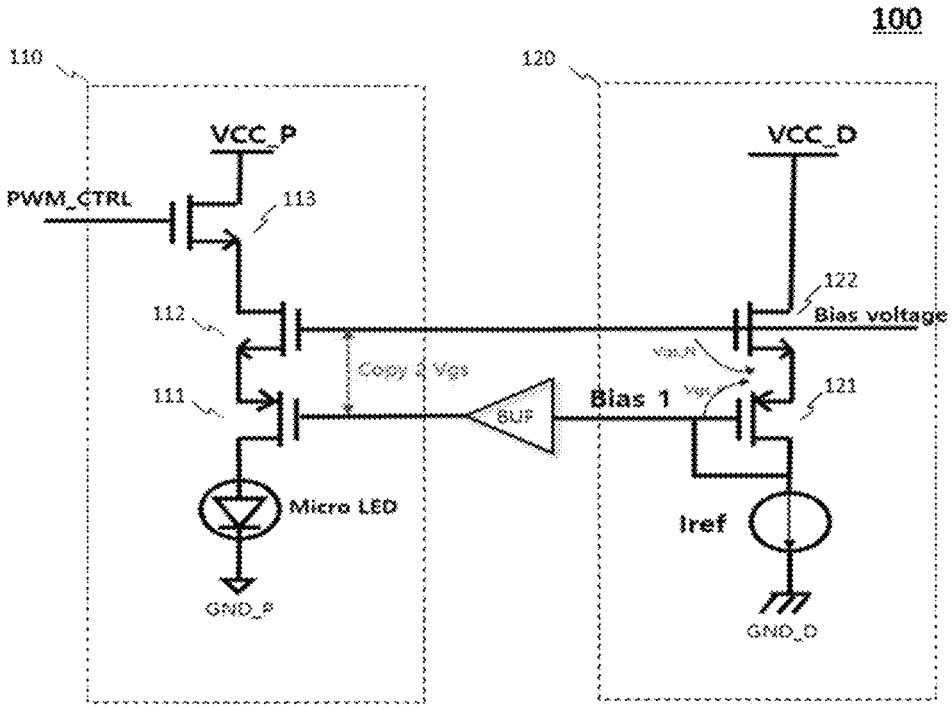
FIG. 7 is a circuit diagram of a fourth embodiment of the PWM-driven method.

FIG. 7 is a circuit diagram of a fourth embodiment of the PWM-driven method.

Referring to FIGS. 4 to 7, an LED driving apparatus 100 according to the present specification may include a plurality of pixel circuits 110 and a driving circuit 120 electrically connected to the plurality of pixel circuits 110. Although only one pixel circuit 110 is illustrated in the following drawings to simplify the drawing, the plurality of pixel circuits 110 may be connected in parallel to a common power source.

The pixel circuit 110 may include an LED Micro LED, a first pixel MOSFET 111, a second pixel MOSFET 112, and a third pixel MOSFET 113. In the present specification, an electrical connection between a pixel positive power source Vcc_P and a pixel negative power source GND_P will be referred to as a "pixel line".

The LED Micro LED may be connected in series to the pixel line. In the drawings, a micro LED is illustrated as an example of the LED Micro LED. Generally, an LED having a width in the range of 1 μm to 100 μm is referred to as a micro LED. Accordingly, the micro LED is a name distinguished from a general LED having a width of 100 μm or more, but the present specification does not limit the LED Micro LED to a micro LED. The LED Micro LED may be replaced with a general LED, a micro LED, and an organic LED (OLED).

The first pixel MOSFET 111 may be connected in series to the pixel line and may be turned on by a voltage output from the driving circuit 120. In the present specification, the term "MOSFET is connected in series" means that a source terminal of the MOSFET and a drain terminal of the MOSFET are connected to the line.

The second pixel MOSFET 112 may be connected in series to the pixel line and may be connected to a source terminal of the first pixel MOSFET 111.

The third pixel MOSFET 113 may be connected in series to the pixel line and may be turned on by a PWM signal PWM_CTRL.

The driving circuit 120 may include a current source Iref, a first driving MOSFET 121, and a second driving MOSFET 122. In the present specification, an electrical connection between a driving positive power source Vcc_D and a driving negative power source GND_D will be referred to as a "driving line".

The current source Iref may be connected in series to the driving line to apply a reference current. The reference current may be set to a current sufficient for the LED Micro LED to emit light.

The first driving MOSFET 121 may be connected in series to the driving line and may be connected to a gate terminal of the first pixel MOSFET 111.

The second driving MOSFET 122 may be connected in series to the driving line and may be connected to a gate terminal of the second pixel MOSFET 112 and a source terminal of the first driving MOSFET 121.

According to one embodiment of the present specification, the first pixel MOSFET 111 may be connected to a negative electrode of the LED Micro LED, and the second pixel MOSFET 112 may be connected between the first pixel MOSFET 111 and the pixel negative power source GND_P.

In this case, the first driving MOSFET 121 may be connected to a negative electrode of the current source Iref, and the second driving MOSFET 122 may be connected between the first driving MOSFET 121 and the driving negative power source GND_D.

Referring to the embodiments illustrated in FIGS. 4 and 6, it is easier to understand.

According to another embodiment of the present specification, the first pixel MOSFET 111 may be connected to a positive electrode of the LED Micro LED, and the second pixel MOSFET 112 may be connected between the first pixel MOSFET 111 and the pixel positive power source Vcc_P.

In this case, the first driving MOSFET 121 may be connected to a positive electrode of the current source Iref, and the second driving MOSFET 122 may be connected between the first driving MOSFET 121 and the driving positive power source Vcc_D.

Referring to the embodiments illustrated in FIGS. 5 and 7, it is easier to understand.

Meanwhile, as in the embodiments illustrated in FIGS. 4 to 7, the first pixel MOSFET 111 and the first driving MOSFET 121 may be P-type MOSFETs, and the second pixel MOSFET 112 and the second driving MOSFET 122 may be N-type MOSFETs. In this case, a gate terminal of the first driving MOSFET 121 and a drain terminal of the first driving MOSFET 121 may be short-circuited.

According to one embodiment of the present specification, a gate terminal of the second driving MOSFET 122 and a drain terminal of the second driving MOSFET 122 may be short-circuited.

Referring to the embodiments illustrated in FIGS. 4 and 5, it is easier to understand.

According to another embodiment of the present specification, the gate terminal of the second pixel MOSFET 112 and the gate terminal of the second driving MOSFET 122 may be connected to a bias voltage source.

Meanwhile, the LED driving apparatus 100 according to one embodiment of the present specification may further include a buffer gate BUF connected between the gate terminal of the first pixel MOSFET 111 and the gate terminal of the first driving MOSFET 121.

As described with reference to FIG. 1, in an LED pixel circuit according to the related art, when a current flows through a common impedance generated in a pixel ground GND_P, a voltage drop (IR drop) occurs. Accordingly, it is reduced by an effective voltage of Vgs_pixel in a MOSFET connected to an LED.

Figure 12:
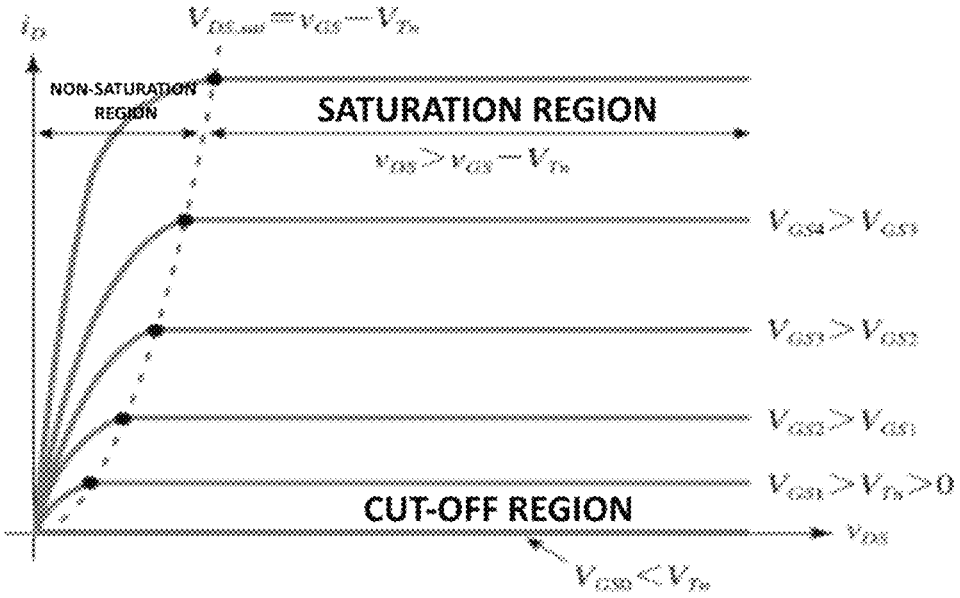
FIG. 12 is a Vgs output characteristic curve of a metal oxide semiconductor field-effect transistor (MOSFET) according to a voltage drop.

FIG. 12 is a Vgs output characteristic curve of a MOSFET according to a voltage drop.

Referring to FIG. 12, it may be seen that, in a saturation mode, as an effective voltage of Vgs decreases, an output current decreases together.

On the other hand, in the LED driving apparatus according to the present specification, even when a voltage drop (IR drop) occurs in the pixel negative power source GND_P, the voltage drop (IR drop) only affects a voltage at a drain terminal of the second pixel MOSFET and does not affect Vgs of the first pixel MOSFET, and thus an influence of an output current flowing through the pixel line may be minimized.

Hereinafter, a voltage-driven LED driving apparatus will be described. However, for the same parts as those of the PWM-driven LED driving apparatus described above, duplicated description thereof will be omitted.

Figure 8:
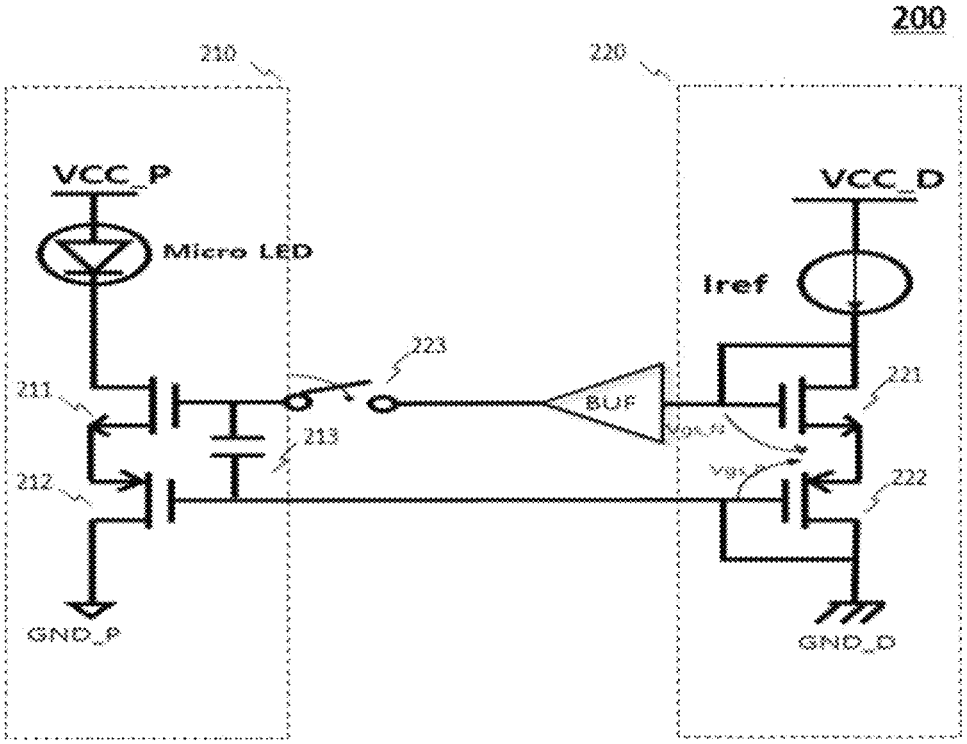
FIG. 8 is a circuit diagram of a first embodiment of a voltage-driven method.

FIG. 8 is a circuit diagram of a first embodiment of the voltage-driven method.

Figure 9:
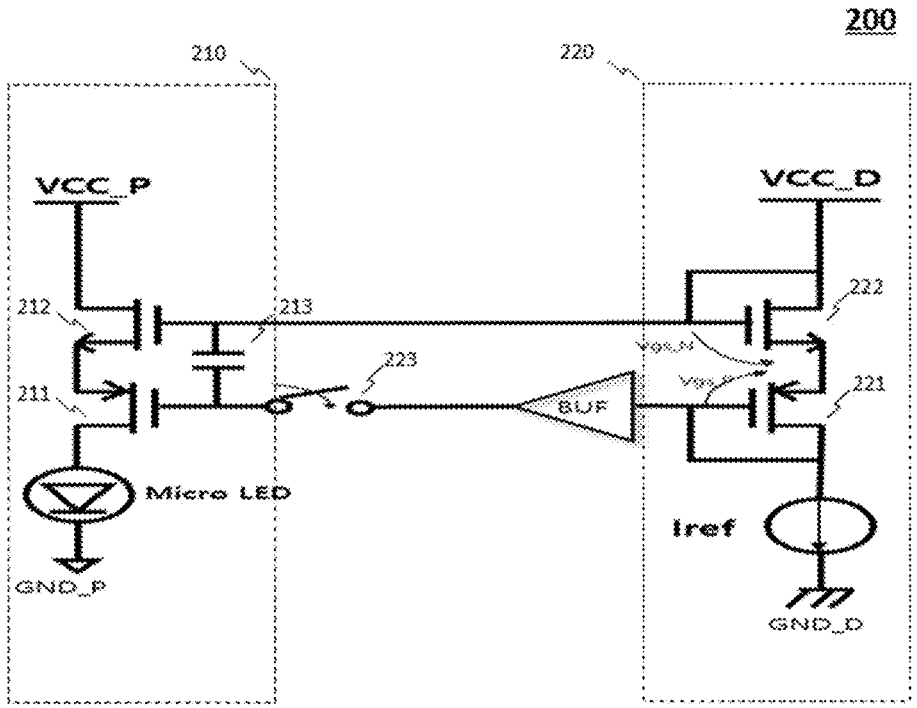
FIG. 9 is a circuit diagram of a second embodiment of the voltage-driven method.

FIG. 9 is a circuit diagram of a second embodiment of the voltage-driven method.

Figure 10:
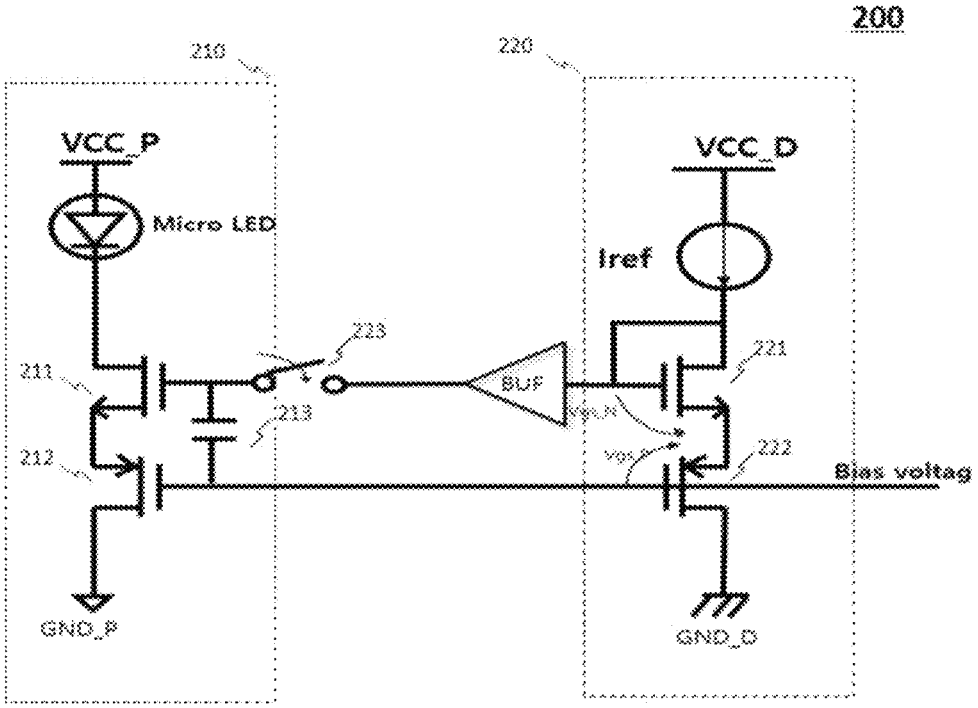
FIG. 10 is a circuit diagram of a third embodiment of the voltage-driven method.

FIG. 10 is a circuit diagram of a third embodiment of the voltage-driven method.

Figure 11:
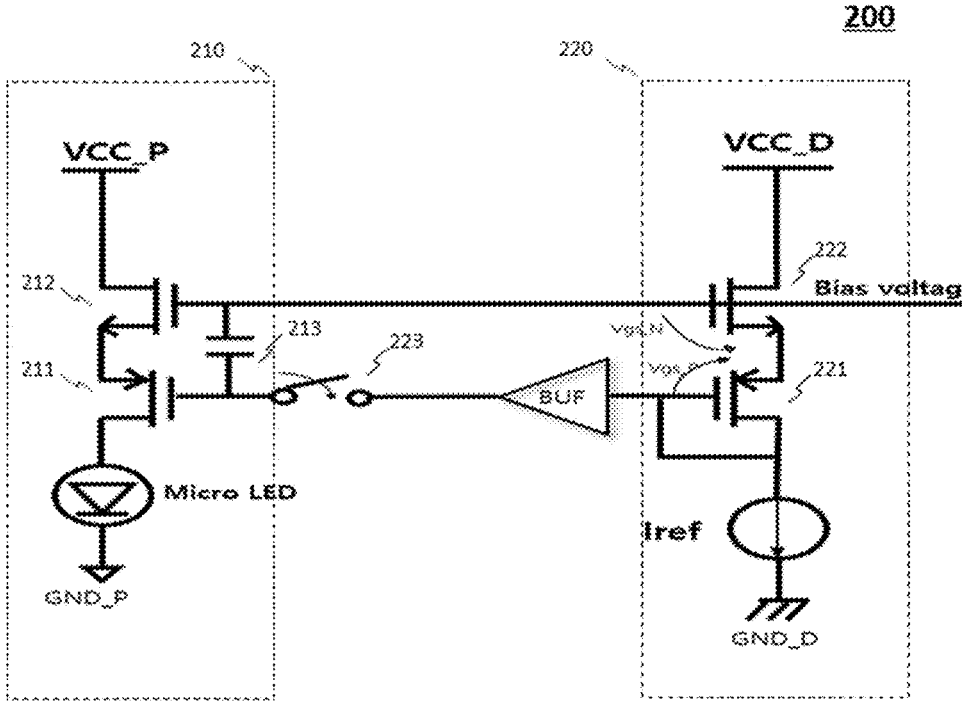
FIG. 11 is a circuit diagram of a fourth embodiment of the voltage-driven method.

FIG. 11 is a circuit diagram of a fourth embodiment of the voltage-driven method.

Referring to FIGS. 8 to 11, an LED driving apparatus 200 according to the present specification may include a plurality of pixel circuits 210 and a driving circuit 220 electrically connected to the plurality of pixel circuits 210. Although only one pixel circuit 210 is illustrated in the following drawings to simplify the drawing, the plurality of pixel circuits 210 may be connected in parallel to a common power source.

The pixel circuit 210 may include an LED Micro LED, a first pixel MOSFET 211, a second pixel MOSFET 212, and a capacitor 213.

The LED Micro LED may be connected in series to the pixel line.

The first pixel MOSFET 211 may be connected in series to the pixel line and may be turned on by a voltage output from the driving circuit 220.

The second pixel MOSFET 212 may be connected in series to the pixel line and may be connected to a source terminal of the first pixel MOSFET 211.

The capacitor 213 may be connected between a gate terminal of the first pixel MOSFET 211 and a gate terminal of the second pixel MOSFET 212.

The driving circuit 220 may include a current source Iref, a first driving MOSFET 221, a second driving MOSFET 222, and a switch element 223.

The current source Iref may be connected in series to the driving line to apply a reference current.

The first driving MOSFET 221 may be connected in series to the driving line and may be connected to the gate terminal of the first pixel MOSFET 211.

The second driving MOSFET 222 may be connected in series to the driving line and may be connected to the gate terminal of the second pixel MOSFET 212 and a source terminal of the first driving MOSFET 221.

The switch element 223 may be connected between the gate terminal of the first pixel MOSFET 211 and a gate terminal of the first driving MOSFET 221.

According to one embodiment of the present specification, the first pixel MOSFET 211 may be connected to a negative electrode of the LED Micro LED, and the second pixel MOSFET 212 may be connected between the first pixel MOSFET 211 and the pixel negative power source GND_P.

In this case, the first driving MOSFET 221 may be connected to a negative electrode of the current source Iref, and the second driving MOSFET 222 may be connected between the first driving MOSFET 221 and the driving negative power source GND_D.

Referring to the embodiments illustrated in FIGS. 8 and 10, it is easier to understand.

According to another embodiment of the present specification, the first pixel MOSFET 211 may be connected to a positive electrode of the LED Micro LED, and the second pixel MOSFET 212 may be connected between the first pixel MOSFET 211 and the pixel positive power source Vcc_P.

In this case, the first driving MOSFET 221 may be connected to a positive electrode of the current source Iref, and the second driving MOSFET 222 may be connected between the first driving MOSFET 221 and the driving positive power source Vcc_D.

Referring to the embodiments illustrated in FIGS. 9 and 11, it is easier to understand.

Meanwhile, as in the embodiments illustrated in FIGS. 8 to 11, the first pixel MOSFET 211 and the first driving MOSFET 221 may be P-type MOSFETs, and the second pixel MOSFET 212 and the second driving MOSFET 222 may be N-type MOSFETs. In this case, a gate terminal of the first driving MOSFET 221 and a drain terminal of the first driving MOSFET 221 may be short-circuited.

According to one embodiment of the present specification, a gate terminal of the second driving MOSFET 222 and a drain terminal of the second driving MOSFET 222 may be short-circuited.

Referring to the embodiments illustrated in FIGS. 8 and 9, it is easier to understand.

According to another embodiment of the present specification, the gate terminal of the second pixel MOSFET 212 and the gate terminal of the second driving MOSFET 222 may be connected to a bias voltage source.

Meanwhile, the LED driving apparatus 200 according to one embodiment of the present specification may further include a buffer gate BUF connected between the switch element 223 and the gate terminal of the first driving MOSFET 221.

The LED driving apparatus 100 or 200 according to the present specification may be a component of an LED display.

According to an aspect of the present specification, an effect of a common impedance is removed from a Vgs terminal of a MOSFET, and the common impedance acts only on a drain-source voltage Vds, and thus an effect of a voltage drop can be minimized.

According to another aspect of the present specification, it is not necessary to consider a design which minimizes a common impedance for a pixel line and a driving line, and a metal layer can be saved.

According to still another aspect of the present specification, a touch-embedded design can be facilitated by reducing a metal area required for a pixel line and a driving line.

It should be noted that the advantageous effects of the present disclosure are not limited to the above-described effects, and other effects that are not described herein will be apparent to those skilled in the art from the following descriptions.

While the embodiments of the present specification have been described with reference to the accompanying drawings, it will be understood by those skilled in the art that various modifications can be made without departing from the scope of the present disclosure and without changing essential features. Therefore, the above-described embodiments should be considered in a descriptive sense only and not for purposes of limitation.

What is claimed is:

1. A light-emitting diode (LED) driving apparatus comprising:

a plurality of pixel circuits; and a driving circuit electrically connected to the plurality of pixel circuits, wherein each of the pixel circuits includes:

a pixel line configured to connect between a pixel positive power source and a pixel negative power source;

an LED connected in series to the pixel line;

a first pixel metal oxide semiconductor field-effect transistor (MOSFET) connected in series to the pixel line and turned on by a voltage output from the driving circuit;

a second pixel MOSFET connected in series to the pixel line and connected to a source terminal of the first pixel MOSFET; and a third pixel MOSFET connected in series to the pixel line and turned on by a pulse width modulation (PWM) signal, and wherein the driving circuit includes:

a driving line configured to connect between a driving positive power source and a driving negative power source;

a current source connected in series to the driving line to apply a reference current;

a first driving MOSFET connected in series to the driving line and connected to a gate terminal of the first pixel MOSFET; and a second driving MOSFET connected in series to the driving line and connected to a gate terminal of the second pixel MOSFET and a source terminal of the first driving MOSFET.

2. The LED driving apparatus of claim 1, wherein the first pixel MOSFET is connected to a negative electrode of the LED, and the second pixel MOSFET is connected between the first pixel MOSFET and the pixel negative power source.

3. The LED driving apparatus of claim 2, wherein the first driving MOSFET is connected to a negative electrode of the current source, and the second driving MOSFET is connected between the first driving MOSFET and the driving negative power source.

4. The LED driving apparatus of claim 1, wherein the first pixel MOSFET is connected to a positive electrode of the LED, and the second pixel MOSFET is connected between the first pixel MOSFET and the pixel positive power source.

5. The LED driving apparatus of claim 4, wherein the first driving MOSFET is connected to a positive electrode of the current source, and the second driving MOSFET is connected between the first driving MOSFET and the driving positive power source.

6. The LED driving apparatus of claim 1, wherein the first pixel MOSFET and the first driving MOSFET are P-type MOSFETs, the second pixel MOSFET and the second driving MOSFET are N-type MOSFETs, and a gate terminal and a drain terminal of the first driving MOSFET are short-circuited.

7. The LED driving apparatus of claim 6, wherein a gate terminal of the second driving MOSFET and a drain terminal of the second driving MOSFET are short-circuited.

8. The LED driving apparatus of claim 6, wherein the gate terminal of the second pixel MOSFET and a gate terminal of the second driving MOSFET are connected to a bias voltage source.

9. The LED driving apparatus of claim 6, further comprising a buffer gate connected between the gate terminal of the first pixel MOSFET and the gate terminal of the first driving MOSFET.

10. A light-emitting diode (LED) display comprising the LED driving apparatus according to claim 1.

* * * * *